US006795027B2

(12) United States Patent
Boyle

(10) Patent No.: US 6,795,027 B2
(45) Date of Patent: Sep. 21, 2004

(54) ANTENNA ARRANGEMENT

(75) Inventor: Kevin R. Boyle, Horsham (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/128,840

(22) Filed: Apr. 24, 2002

(65) Prior Publication Data

US 2002/0171590 A1 Nov. 21, 2002

(30) Foreign Application Priority Data

May 19, 2001 (GB) ..... 0112265

(51) Int. Cl.[7] ..... H01Q 1/24
(52) U.S. Cl. ..... 343/702; 343/752
(58) Field of Search ..... 343/702, 700 MS, 343/846, 895, 725, 900, 752

(56) References Cited

U.S. PATENT DOCUMENTS 4,491,843 A 1/1985 Bouboulex ..... 343/702
5,847,682 A 12/1998 Ke ..... 343/752
5,912,647 A * 6/1999 Tsuru et al. ..... 343/700 MS
6,025,805 A * 2/2000 Smith et al. ..... 343/702
6,127,979 A 10/2000 Zhou et al. ..... 343/702

FOREIGN PATENT DOCUMENTS

WO WO0076023 12/2000 ..... H01Q/1/24
WO WO0213306 2/2002 ..... H01Q/1/24

* cited by examiner

*Primary Examiner*—James Vannucci
(74) *Attorney, Agent, or Firm*—Gregory L. Thorne

(57) ABSTRACT

An antenna arrangement (300) comprises a ground conductor (102) on which is mounted an antenna (304). The antenna is small relative to a wavelength at operational frequencies of the antenna arrangement (300) and the dimensions of the antenna (304) are selected so that the combined impedance of the antenna (304) and ground conductor (102) is suitable for driving via a conventional matching circuit. This condition is met when the bandwidth of the arrangement is dominated by that of the antenna and ground conductor, rather than that of the matching circuit. In one embodiment the antenna is a triangular conducting element which is considerably wider than its height, the length being sufficient to to give a reasonable resistance and the width being sufficient to reduce the reactance to a level that can reasonably be matched.

20 Claims, 5 Drawing Sheets

ANTENNA ARRANGEMENT

The present invention relates to an antenna arrangement for use in a wireless terminal, for example a mobile phone handset, and to a radio communications apparatus incorporating such an arrangement.

Wireless terminals, such as mobile phone handsets, typically incorporate either an external antenna, such as a normal mode helix or meander line antenna, or an internal antenna, such as a Planar Inverted-F Antenna (PIFA) or similar.

Such antennas are large in relation to a mobile phone handset, but small in relation to a wavelength and therefore, owing to the fundamental limits of small antennas, narrowband and relatively lossy. However, cellular radio communication systems typically have a fractional bandwidth of 10% or more. To achieve such a bandwidth from a PIFA for example requires a considerable volume, there being a direct relationship between the bandwidth of a patch antenna and its volume, but such a volume is not readily available with the current trends towards small handsets. Hence, because of the limits referred to above, it is not considered feasible to achieve efficient wideband radiation from small antennas in present-day wireless terminals.

A further problem with known antenna arrangements for wireless terminals is that they are generally unbalanced, and therefore couple strongly to the terminal case. As a result a significant amount of radiation emanates from the terminal itself rather than the antenna.

An object of the present invention is to provide an improved antenna arrangement for a wireless terminal.

According to a first aspect of the present invention there is provided an antenna arrangement comprising an antenna element adapted for driving against a ground conductor, wherein the antenna element is small relative to a wavelength at operational frequencies of the antenna arrangement and wherein the dimensions of the antenna element are arranged so that, when driven via a matching circuit, the bandwidth of the antenna arrangement is dominated by the antenna element and the ground conductor.

The bandwidth is dominated by the antenna and ground conductor rather than the matching circuit when the impedance of the combination of the antenna element and ground conductor is reasonably well matched to a transceiver. If the mismatch is too great, the bandwidth is dominated by the matching circuit, and in addition losses in the matching circuit become too great for efficient operation.

In an antenna arrangement made in accordance with the present invention, the majority of the radiated power comes from the ground conductor (typically a mobile phone handset case or a printed circuit board ground conductor). Suitable choices of geometry for the antenna element enable the required impedance to be provided while the antenna element remains electrically very small.

Such an antenna arrangement is particularly suitable for dual band operation, being driven via a simple via a dual band matching circuit. One example embodiment is suitable for use at the frequencies employed in GSM and DCS1800 systems.

In one embodiment of the present invention the antenna element comprises a triangular conductor that is significantly wider than its height. Such an element is particularly suitable for use with a mobile phone handset where the width of the antenna element is not particularly important while the height generally needs to be minimised to enable the design of a compact handset. In one example of this embodiment the combined height of the antenna and its associated feed pin is only 11 mm while providing an efficiency of 70% at 1800 MHz (at which frequency 11 mm is approximately 0.07 wavelengths).

According to a second aspect of the present invention there is provided a radio communications apparatus including an antenna arrangement made in accordance with the first aspect of the present invention.

The present invention is based upon the recognition, not present in the prior art, that an antenna and a wireless handset can be considered to be two halves of an asymmetrically fed antenna, and on the further recognition that choice of a suitable geometry for the antenna enables a reasonable impedance match to be achieved.

Embodiments of the present invention will now be described, by way of example, with reference to the accompanying drawings, wherein.

In the drawings the same reference numerals have been used to indicate corresponding features.

Figure 1:
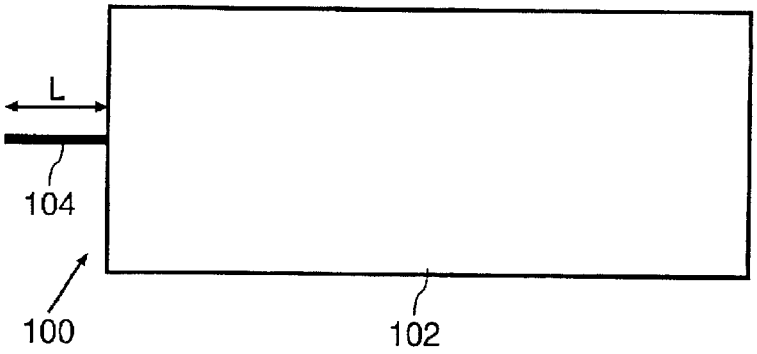
FIG. 1 is a plan view of an antenna mounted on a rectangular conductor.

FIG. 1 is a plan view of a simplified embodiment of a conventional wireless terminal 100, comprising a rectangular ground conductor 102 on which a a monopole antenna 104, of length L, is mounted. The ground conductor 102 would typically comprise a Printed Circuit Board (PCB) ground plane or metallisation provided on the body of the wireless terminal 100 for EMC (Electro-Magnetic Compatibility) purposes.

The antenna 104 and ground conductor of a wireless terminal 102, for example a mobile phone handset, form two halves of an asymmetric radiating structure. Thus, both halves contribute to the impedance seen at the terminals. Typical handsets are close to half-wave long at frequencies used for GSM (Global System for Mobile communications) and full-wave at frequencies used for DCS1800. At these frequencies the handset side of the structure presents a high impedance, particularly a high resistance. Owing to its size, the handset side of the structure also has a low Q (typically of the order of 1 or 2).

Typical antennas 104 are much smaller than a wavelength at both GSM and DCS (although this is obviously more the case at GSM). Therefore, the antenna side of the structure presents a low resistance and a large capacitive reactance (this is particularly the case at GSM). When a small antenna is used in combination with a handset close to half or full-wave in length, it is the handset that dominates the contribution to the resistance. Because of this, most of the radiated power eminates from the (low Q) handset, which explains why mobile phones with small antennas can achieve unexpectedly high bandwidths. The antenna contributes most to the reactance. The antenna also determines the absolute value of the resistance, though not the position of the peaks with frequency this is determined by the half wave (or multiples thereof) resonance of the handset.

Figure 2:
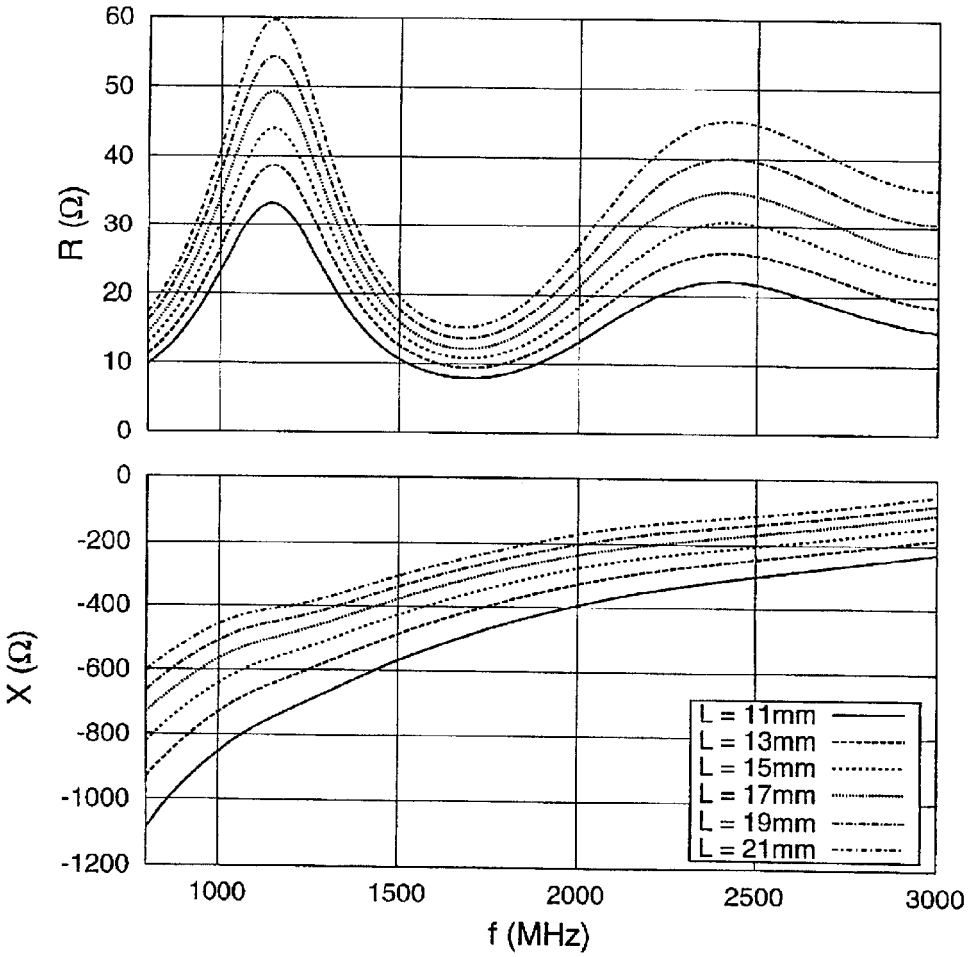
FIG. 2 is a graph of simulated resistance R and reactance X for a range of lengths L of the antenna of FIG. 1.

These phenomena are illustrated in FIG. 2, which shows curves of resistance (R) and reactance (X) for a 1 mm-wide monopole antenna 104 mounted centrally at the top of a 100×40×1 mm ground conductor 102 (representing a handset case or PCB ground plane) for frequencies f between 800 and 3000 MHz. Curves are shown for a range of lengths L of the antenna 104, ranging from 11 to 21 mm.

It can be seen from FIG. 2 that the resistance peaks occur at approximately 1.2 and 2.4 GHz. These peaks correspond to the half and full-wave resonant frequencies, respectively, of the handset, which are close to the GSM900 and DCS1800 bands for handsets in the range of approximately 80 to 160 mm long. By varying the length L of the antenna 104 the numeric values of both the resistance and the reactance can be varied (both increasing with antenna length). However, the length L does not affect the shape of the resistance or reactance curves as long as the antenna 104 is short compared to the handset 102. The geometry of the antenna 104 predominantly influences the reactance X. The resistance R is only a weak function of the antenna geometry but, as already mentioned, a strong function of the antenna length.

The present invention takes advantage of this insight into antenna behaviour by providing a wireless terminal having a small antenna which is not well matched to the impedance of its driving circuitry, typically 50 Ω. The antenna geometry and height are arranged to be just enough to provide a reasonably low reactance. The antenna is also large enough that the handset resistance approaches 50 Ω (or a resistance level that can be relatively easily matched to 50 Ω).

Figure 3:
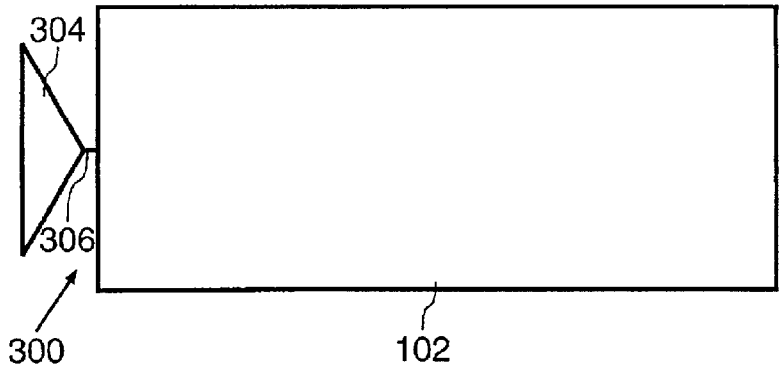
FIG. 3 is a plan view of an triangular antenna element mounted on a rectangular conductor.

FIG. 3 is a plan view of a first embodiment of the present invention. It comprises a 100×40×1 mm ground conductor 102, as in FIG. 1, on which is mounted a triangular antenna 304. The antenna 304 is a 9 mm high, 30 mm wide triangular conducting element mounted 2 mm from the top the ground conductor 102 and fed via a 2 mm long feed pin 306. Here the antenna 304 is just long enough to give a reasonable resistance and wide enough to reduce the reactance to a level that can reasonably be matched.

Figure 4:
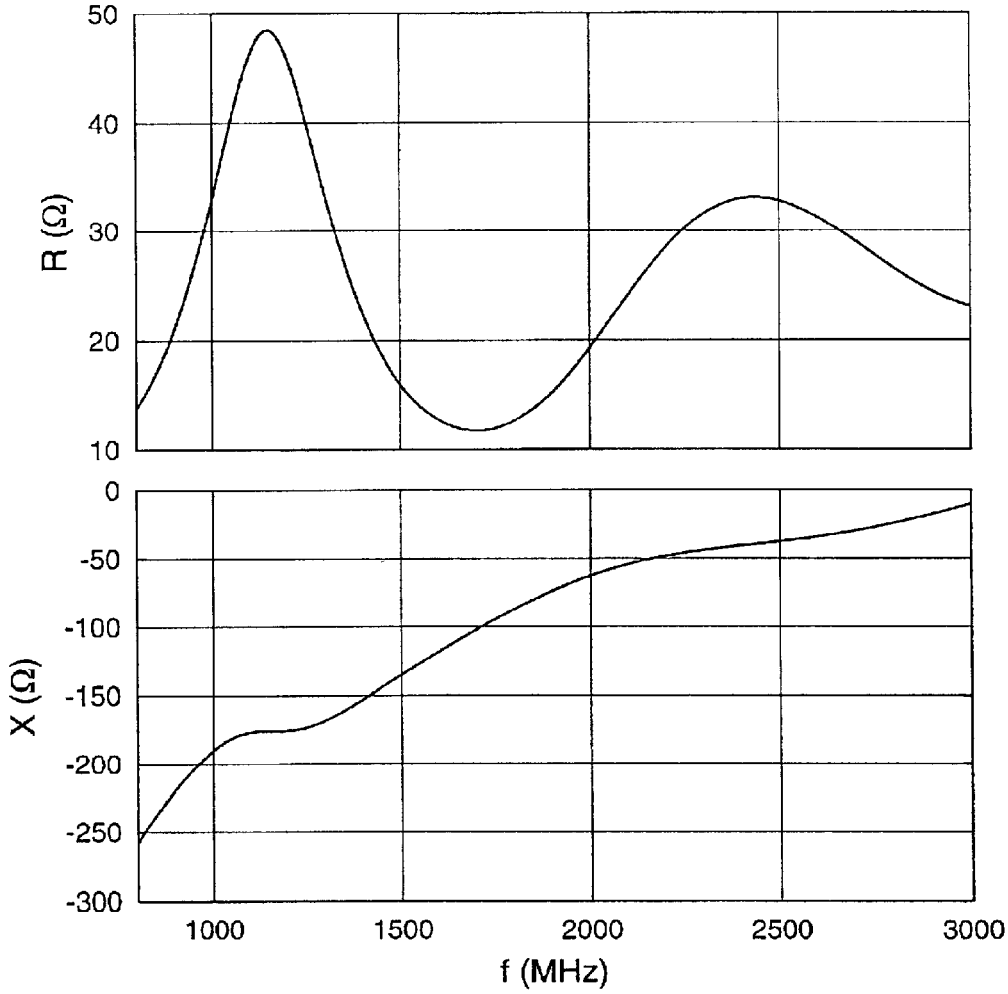
FIG. 4 is a graph of simulated resistance R and reactance X for the antenna of FIG. 3.

FIG. 4 shows curves of resistance (R) and reactance (X) for the antenna configuration of FIG. 3 for frequencies f between 800 and 3000 MHz. It can clearly be seen that the frequencies of the resistive peaks are unchanged from those of FIG. 2, i.e. they are dependent on the ground conductor 102. However, the resistance and reactance are high enough to make matching feasible due to the width and flared nature of the antenna 304. The resistance is similar to that of the 17 mm-long monopole antenna 104, as shown in FIG. 2, the effects of the halving of the length of the antenna 304 being compensated for by the increase in the width by a factor of 30. The increased width greatly reduces the reactance of the antenna 304 compared to the monople antenna 104, making matching significantly easier to implement.

Figure 5:
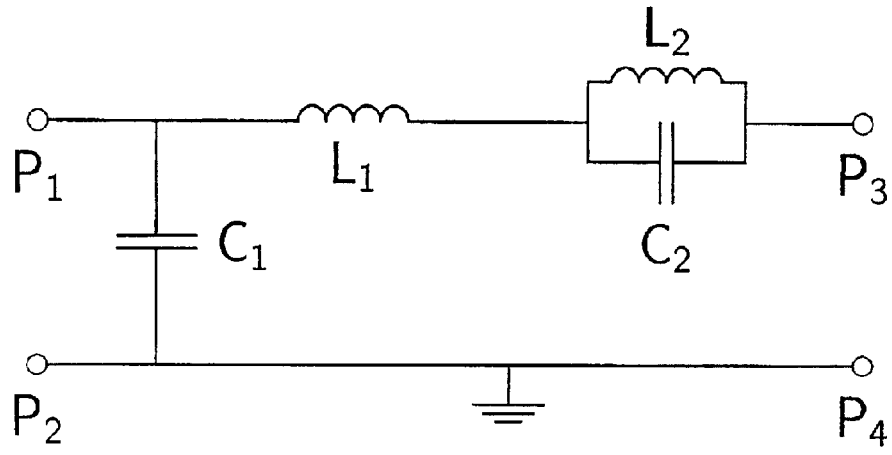
FIG. 5 is a circuit diagram of a dual-band matching circuit for use with the antenna of FIG. 3.

The antenna 304 may be fed via a dual-band matching circuit. An example of a suitable circuit for GSM and DCS1800 applications is shown in FIG. 5, where the components used have the following values: $C_1$ is 1 pF; $L_1$ is 14 nH; $C_2$ is 3 pF and $L_2$ is 7 nH. In use, the matching circuit is fed from a 50 Ω source across connections $P_1$ and $P_2$, $P_3$ is connected to the feed point 306 and $P_4$ is connected to the ground plane 102.

Figure 6:
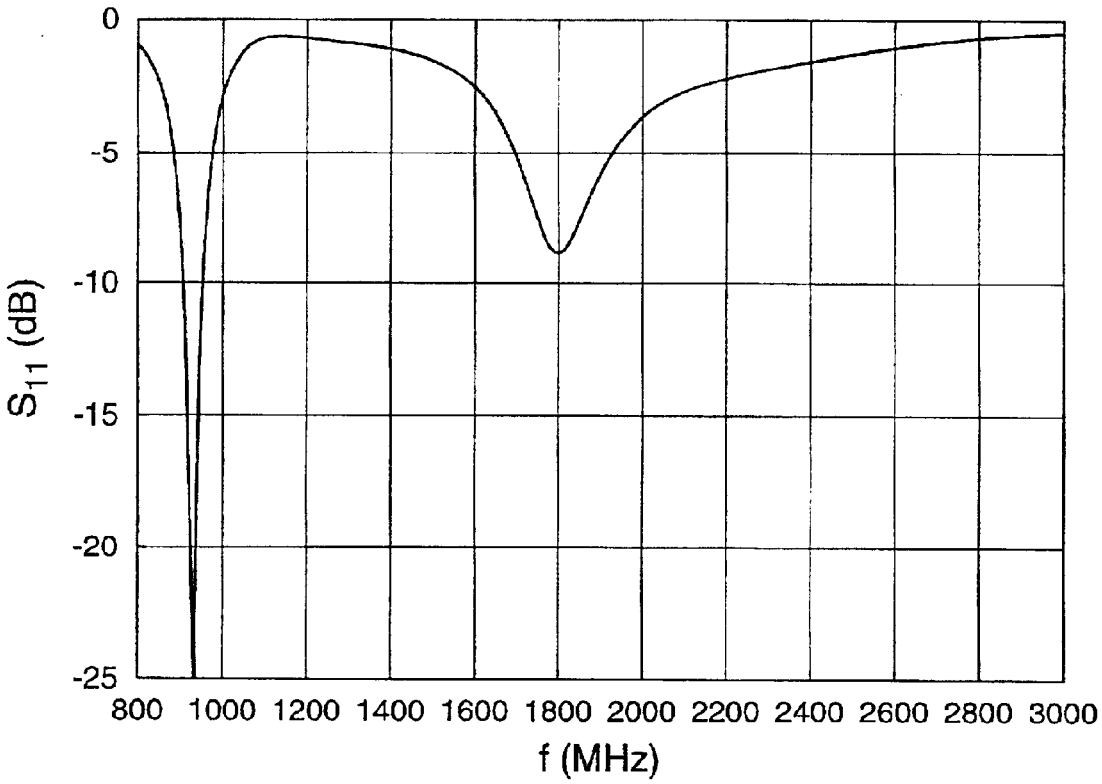
FIG. 6 is a graph of simulated return loss $S_{11}$ in dB against frequency f in MHz for the antenna of FIG. 3 driven via the matching circuit of FIG. 5.
Figure 7:
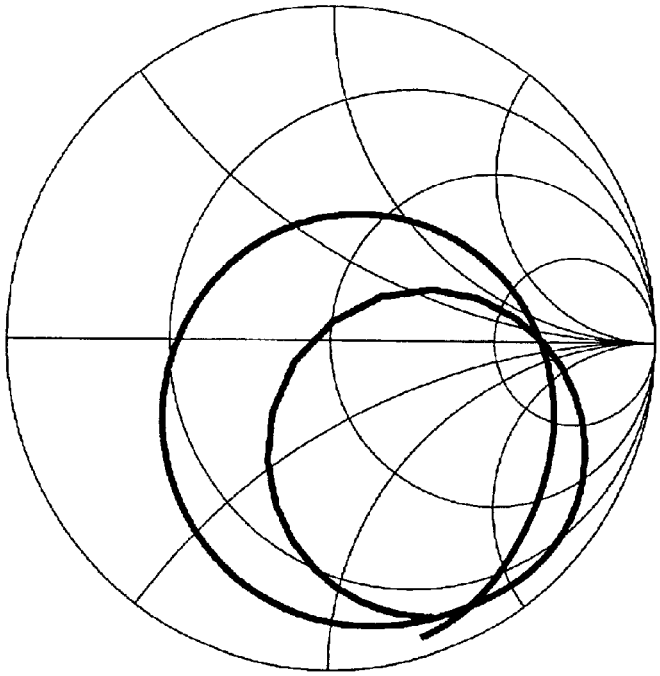
FIG. 7 is a Smith chart showing the simulated impedance of the antenna of FIG. 3 driven via the matching circuit of FIG. 5 over the frequency range 800 to 3000 MHz.

Simulations of the combination of the antenna 304 and ground plane 102 shown in FIG. 3 fed via such the dual-band matching circuit shown in FIG. 5 were performed. Results for return loss $S_{11}$ are shown in FIG. 6 and a Smith chart is shown in FIG. 7, in both cases for frequencies f between 800 and 3000 MHz. The two resonances are centred on 930 MHz, with a 6 dB bandwidth of 80 MHz, and 1805 MHz, with a 6 dB bandwidth of 175 MHZ.

It can be seen that dual band operation is readily achieved. The inductors and capacitors used in this simulation have been assumed to have quality factors of 50, which is reasonable for inexpensive miniaturised SMD components. The resulting efficiency is approximately 55% at GSM and 70% at DCS. This is of the same order as with conventional antennas. The efficiency can be improved using components with higher quality factors. It is also clear from FIG. 4 that the handset dimensions are not optimum for operation at GSM and DCS. If the handset dimensions were optimised, a smaller antenna or a more wideband match could be realised.

Inspection of the Smith chart of FIG. 7 shows that this configuration also has the useful property that resonance (zero reactance) is achieved twice for each band. In both cases the higher frequency resonance has a higher resistance. This is convenient, since the receive band is usually at a higher frequency in a frequency duplex system. Since receivers are generally high impedance devices and transmitters low impedance devices, performance can be improved by maintaining a low impedance path between a transmitter and the antenna 304 and a high impedance path between the antenna 304 and a receiver. Conventionally, a 50 Ω system impedance is used with matching as required. This matching is lossy and may also reduce the bandwidth seen at both the transmitter and receiver.

Figure 8:
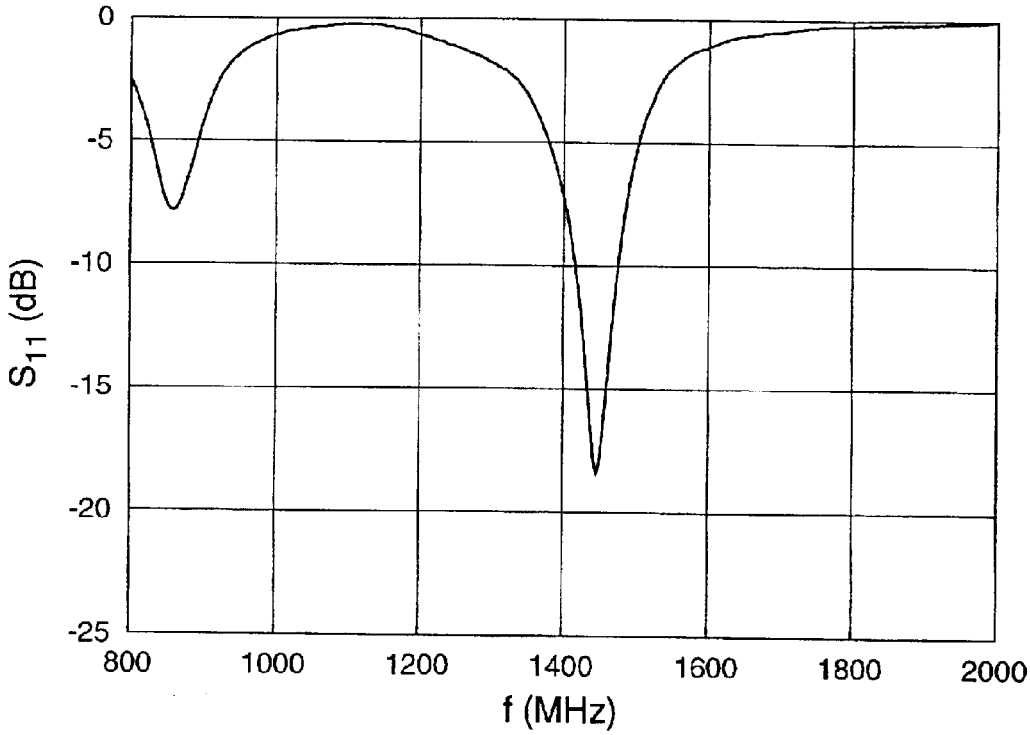
FIG. 8 is a graph of measured return loss $S_{11}$ in dB against frequency f in MHz for the antenna of FIG. 3 driven via the matching circuit of FIG. 5.
Figure 9:
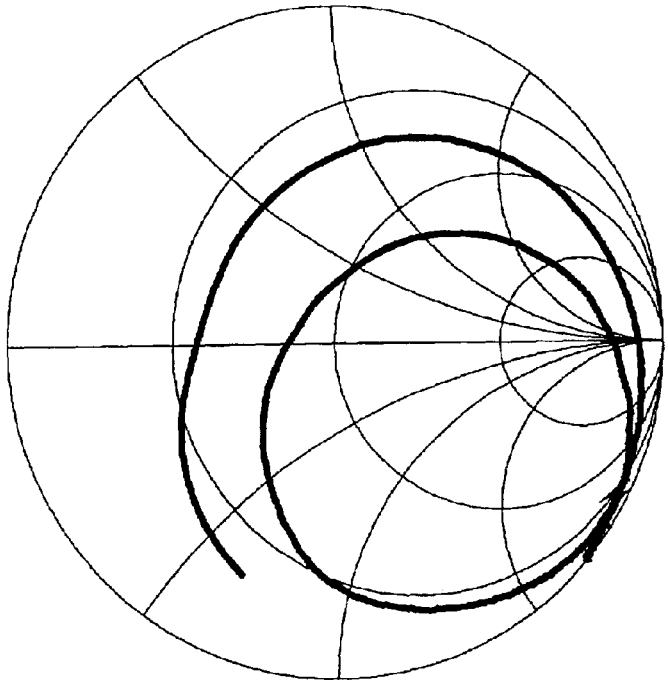
FIG. 9 is a Smith chart showing the measured impedance of the antenna of FIG. 3 driven via the matching circuit of FIG. 5 over the frequency range 800 to 2000 MHz.

A test piece corresponding to the embodiment shown in FIG. 3 was produced to verify the practical application of the simulation results presented above. The test piece was driven via a matching circuit of the form shown in FIG. 5, using "off the shelf" components similar in value to those identified above. Measurements of the return loss $S_{11}$ of this embodiment are shown in FIG. 8 for frequencies f between 800 and 2000 MHz. A Smith chart illustrating the impedance of this embodiment over the same frequency range is shown in FIG. 9.

The experimental results confirm that dual band operation can be obtained in the manner predicted by simulations. The difference in resonant frequencies between simulations and measurements is caused by a combination of the use of standard component values in the experimental matching circuit and the presence of circuit parasitics not accounted for in the simulations. Neither of these factors are a barrier to implementation of a practical antenna arrangement.

Figure 10:
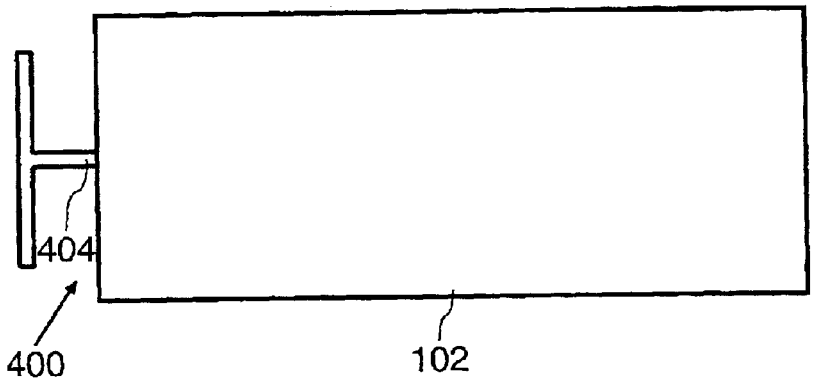
FIG. 10 is a plan view of a T-shaped antenna element mounted on a rectangular conductor.

FIG. 10 is a plan view of a second embodiment of the present invention. It comprises a 100×40×1 mm ground conductor 102, as in FIG. 1, on which is mounted a T-shaped antenna 404. The height and width of the antenna 404 are similar to the triangular antenna 304 of FIG. 3, and therefore provide similar benefits, while using a reduced amount of conductor.

Figure 11:
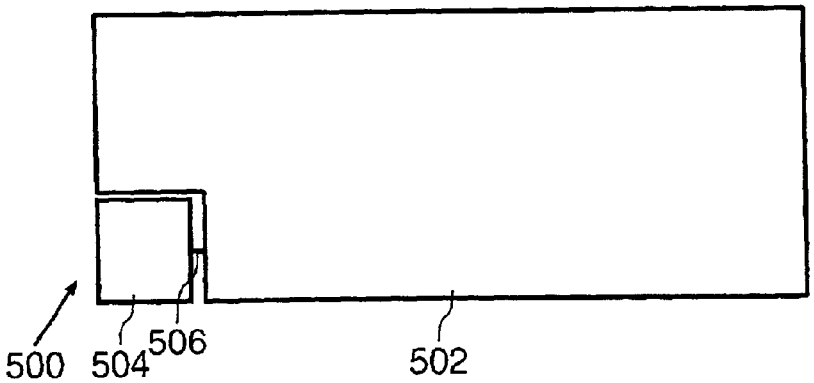
FIG. 11 is a plan view of a rectangular antenna element mounted on a rectangular conductor having a cutout.

FIG. 11 is a plan view of a third embodiment of the present invention. It comprises a 100×40×1 mm ground conductor 502 from which one corner has been cut out. A rectangular antenna 504 is mounted in the cut-out, fed via a feed pin 406.

A range of other embodiments will also be apparent to the skilled person. For example, a helical or meander line element having a much shorter length than would conventionally be used could be provided instead of the antennas 304,404,504 described above.

From reading the present disclosure, other modifications will be apparent to persons skilled in the art. Such modifications may involve other features which are already known in the design, manufacture and use of antenna arrangements and component parts thereof, and which may be used instead of or in addition to features already described herein.

In the present specification and claims the word "a" or "an" preceding an element does not exclude the presence of a plurality of such elements. Further, the word "comprising" does not exclude the presence of other elements or steps than those listed.

What is claimed is:

1. An antenna arrangement comprising an antenna element adapted for driving with a voltage referenced to a ground conductor, the antenna element comprising a feeding coupling configured to be operationally coupled to a driving circuit, wherein the antenna element is substantially smaller than a wavelength at operational frequencies of the antenna arrangement, the dimensions of the antenna element are arranged so that, when driven via a matching circuit, the bandwidth of the antenna arrangement is predominantly determined by the antenna element and the ground conductor, and the antenna element is non-resonant, having a width significantly larger than its height, wherein the width of the antenna element is configured to extend outward in two directions from the feeding coupling and substantially parallel to a proximate side of the ground conductor and the length of the antenna element is configured to extend substantially outward from the proximate side of the ground conductor.

2. The arrangement as claimed in claim 1, wherein an impedance of the antenna is suitable for being driven by a 50 Ohm source.

3. The arrangement as claimed in claim 1, wherein the antenna element comprises a triangular conductor.

4. The arrangement as claimed in claim 1, wherein the antenna element comprises a 'T'-shaped conductor.

5. The arrangement as claimed in claim 1, wherein the antenna element comprises a helical element having an electrical length of substantially less than a wavelength.

6. The arrangement as claimed in claim 1, further comprising a dual band matching circuit.

7. The arrangement as claimed in claim 6, wherein a higher operational frequency of the dual band matching circuit is substantially twice a lower operational frequency of the matching circuit.

8. The arrangement as claimed in claim 7, wherein the higher operational frequency is suitable for a DCS1800 system and the lower operational frequency is suitable for a GSN system.

9. A radio communications apparatus including an antenna arrangement as claimed in claim 1.

10. A dual-band antenna that exhibits a resistance peak at two substantially different operational frequencies, comprising a ground conductor, a single non-resonant antenna element, and a matching circuit, operably coupled to the antenna element and the ground conductor, that is configured to provide the two resistance peaks in combination with the single antenna element, wherein the non-resonant antenna element is substantially smaller than a wavelength at the operational frequencies of the antenna, the antenna element includes:

a first end constituting a terminal for coupling the antenna element to the matching circuit, and a second end at a distance from the first end, the antenna element being shaped such that a width of the second end is greater than the distance between the first and second ends, and is selected to reduce a reactance of the antenna element to a level that can be matched with the matching circuit while obtaining a desired bandwidth.

11. The antenna of claim 10, wherein the matching circuit comprises:

first and second feed points connected respectively to external rf circuitry and to ground, third and fourth feed points connected respectively to the terminal of the antenna element end to ground, a first capacitor coupled between the first and second feed points, and, in series between the first and third feed points:

a first inductor and a parallel arrangement of a second inductor and a second capacitor.

12. The antenna as claimed in claim 11, wherein the antenna element comprises a triangular conductor.

13. The antenna as claimed in claim 11, wherein the antenna element comprises a T-shaped conductor.

14. The antenna as claimed in claim 11, wherein the two operational frequencies include a first frequency and a second frequency, the first frequency is substantially twice the second frequency.

15. The antenna as claimed in claim 14, wherein the first frequency is suitable for a DCS1800 system and the second frequency is suitable for a GSM system.

16. The antenna as claimed in claim 10, wherein the antenna element comprises a triangular conductor.

17. The antenna as claimed in claim 10, wherein the antenna element comprises a T-shaped conductor.

18. The antenna as claimed in claim 10, wherein the two operational frequencies include a first frequency and a second frequency, and the first frequency is substantially twice the second frequency.

19. A dual-band antenna that exhibits a resistance peak at two substantially different operational frequencies, comprising a ground conductor, a single non-resonant antenna element, and a matching circuit, operably coupled to the antenna element and the ground conductor, that is configured to provide the two resistance peaks in combination with the single antenna element, wherein the non-resonant antenna element is a rectangular element having a width and length that is substantially smaller than a wavelength at the operational frequencies of the antenna, and the ground conductor has at least one dimension that corresponds to a multiple of the wavelength at the operational frequency.

20. The antenna of claim 19, wherein the matching circuit comprises:

first and second feed points connected respectively to external rf circuitry and to ground, third and fourth feed points connected respectively to a terminal of the antenna element and to ground, a first capacitor coupled between the first and second feed points, and, in series between the first and third feed points:

a first inductor and a parallel arrangement of a second inductor and a second capacitor.

* * * * *